US008770660B2

(12) United States Patent
Chen et al.

(10) Patent No.: US 8,770,660 B2
(45) Date of Patent: Jul. 8, 2014

(54) CONVERTIBLE ROCKING CHAIR

(75) Inventors: Ho-Sheng Chen, Chiayi County (TW); Chi-Chien Chen, Kaohsiung (TW); Chia-Ming Shen, Kaohsiung (TW)

(73) Assignee: Lerado (Zhong Shan) Industrial Co., Ltd., Zhong Shan, Guang Dong Province (CN)

( * ) Notice: Subject to any disclaimer, the term of this patent is extended or adjusted under 35 U.S.C. 154(b) by 152 days.

(21) Appl. No.: 13/454,318

(22) Filed: Apr. 24, 2012

(65) Prior Publication Data

US 2012/0274105 A1 Nov. 1, 2012

(30) Foreign Application Priority Data

Apr. 26, 2011 (CN) ..... 2011 2 0125561 U

(51) Int. Cl.

| | |
|---|---|
| ***A47C 4/52*** | (2006.01) |
| ***A47D 9/00*** | (2006.01) |
| ***A47D 11/00*** | (2006.01) |
| ***A47D 13/10*** | (2006.01) |
| ***A47D 1/08*** | (2006.01) |

(52) U.S. Cl.

CPC ..... *A47D 13/102* (2013.01); *A47D 9/00* (2013.01); *A47D 11/00* (2013.01); *A47D 1/08* (2013.01)

USPC ..... 297/183.4; 297/131

(58) Field of Classification Search

USPC ..... 297/130, 131, 133, 134, 271, 183.2

See application file for complete search history.

(56) References Cited

U.S. PATENT DOCUMENTS

| | | | | |
|---|---|---|---|---|
| 4,500,133 | A * | 2/1985 | Nakao et al. | 297/131 |
| 5,265,932 | A * | 11/1993 | Leonard | 297/131 |
| 5,935,010 | A * | 8/1999 | Clarke | 472/29 |
| 5,988,743 | A * | 11/1999 | Drexler | 297/250.1 |
| 6,257,598 | B1 * | 7/2001 | Song | 280/7.1 |
| 7,070,188 | B2 * | 7/2006 | Waldman et al. | 280/31 |
| 7,252,333 | B2 * | 8/2007 | Caldwell | 297/259.2 |
| 7,918,499 | B2 * | 4/2011 | Tuckey et al. | 297/183.4 |
| D648,145 | S * | 11/2011 | Chuang | D6/344 |
| 8,197,003 | B2 * | 6/2012 | Rogers | 297/258.1 |
| 8,205,943 | B2 * | 6/2012 | Zhong | 297/274 |
| 2005/0269851 | A1 * | 12/2005 | Li | 297/271.6 |

* cited by examiner

*Primary Examiner* — Jose V Chen

(74) *Attorney, Agent, or Firm* — Muncy, Geissler, Olds & Lowe, P.C.

(57) ABSTRACT

A convertible rocking chair can be converted to use as a rocking-bed, a chair and a rocking-horse. The convertible rocking chair has an arched base rack and a seat frame. The arched base rack has a curved downside for rocking and rolling back and forth against ground. The seat frame includes a left-side rack and a right-side rack for stretching a fabric cover therebetween to form an accommodating space. The left-side rack and right-side rack can be locked in a first position when converted to the rocking-bed or chair, and rotatable to close together in a second position for engaging with a seat board so as to convert to the rocking-horse. The seat frame may pivot to the arched base rack and adjust inclination by a lifting rack when being converted to a chair.

13 Claims, 12 Drawing Sheets

CONVERTIBLE ROCKING CHAIR

BACKGROUND OF THE INVENTION

1. Field of the Invention

The present invention relates generally to a rocking chair, especially to a convertible rocking chair which can be converted to a rocking-bed, a chair and a rocking-horse.

2. Description of the Related Art

The rocking chair is provided for a few-month-old baby to be cradled. Therefore, after the baby has grown up to be able to stand or walk alone, the rocking chair is not needed in general. In other words, a conventional rocking chair has a short duration of use.

SUMMARY OF THE INVENTION

To solve the mentioned shortcoming, the present invention would provide a convertible rocking chair capable of converting to a rocking-bed, a chair and a rocking-horse.

The frame of the convertible rocking chair according to the present invention may include an arched base rack and a seat frame. The arched base rack has a curved downside for rocking and rolling back and forth against ground.

The seat frame includes a left-side rack and a right-side rack for stretching a fabric cover therebetween when being locked in a first position, and for connecting with a seat plate and a handle post when being locked in a second position. When the left-side rack and right-side being locked in the first position, the frame of the rocking chair is capable of converting to the rocking-bed and chair, and when the left-side rack and right-side being locked in the second position and being connected with a seat board, the frame of the rocking chair is then capable of converting to the rocking-horse.

The seat frame may pivot to the arched base rack for adjusting inclination by a lifting rack when being converted to the chair, the rocking chair or the rocking-bed.

BRIEF DESCRIPTION OF THE DRAWINGS

The accompanying drawings, which are included to provide a further understanding of the invention are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention; examples of which are illustrated in the accompanying drawings.

Figure 1:
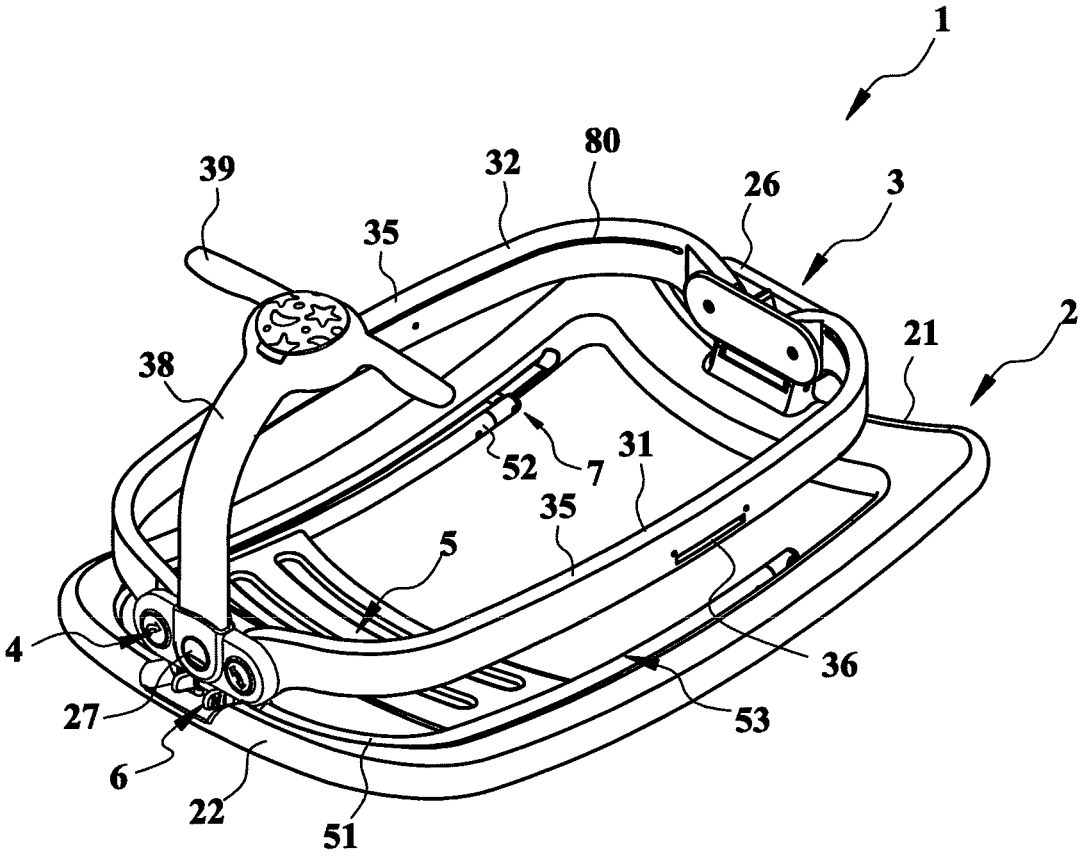
FIG. 1 is a perspective view showing an embodiment of a frame of the convertible rocking chair according to the present invention.

Referring to FIG. 1, a preferred embodiment of a frame 1 of the convertible rocking chair 15 according to the present invention includes at least an arched base rack 2 and a seat frame 3. By rotating and locking the seat frame 3, the convertible rocking chair 15 can be converted to use as a rocking-bed 10, a chair 20 and a rocking-horse 30 as shown in FIGS. 4 to 7.

Figure 2:
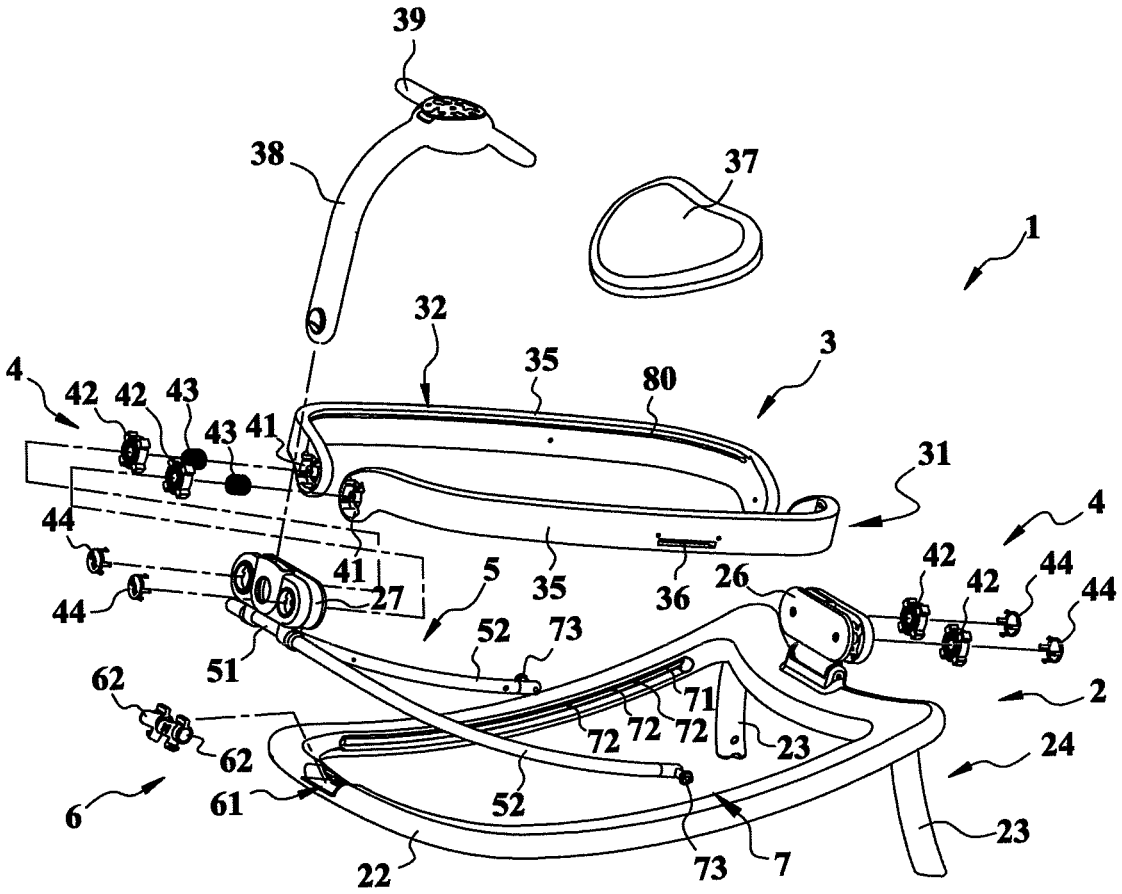
FIG. 2 is a perspective exploded view showing the frame of the convertible rocking chair according to the present invention.
Figure 3:
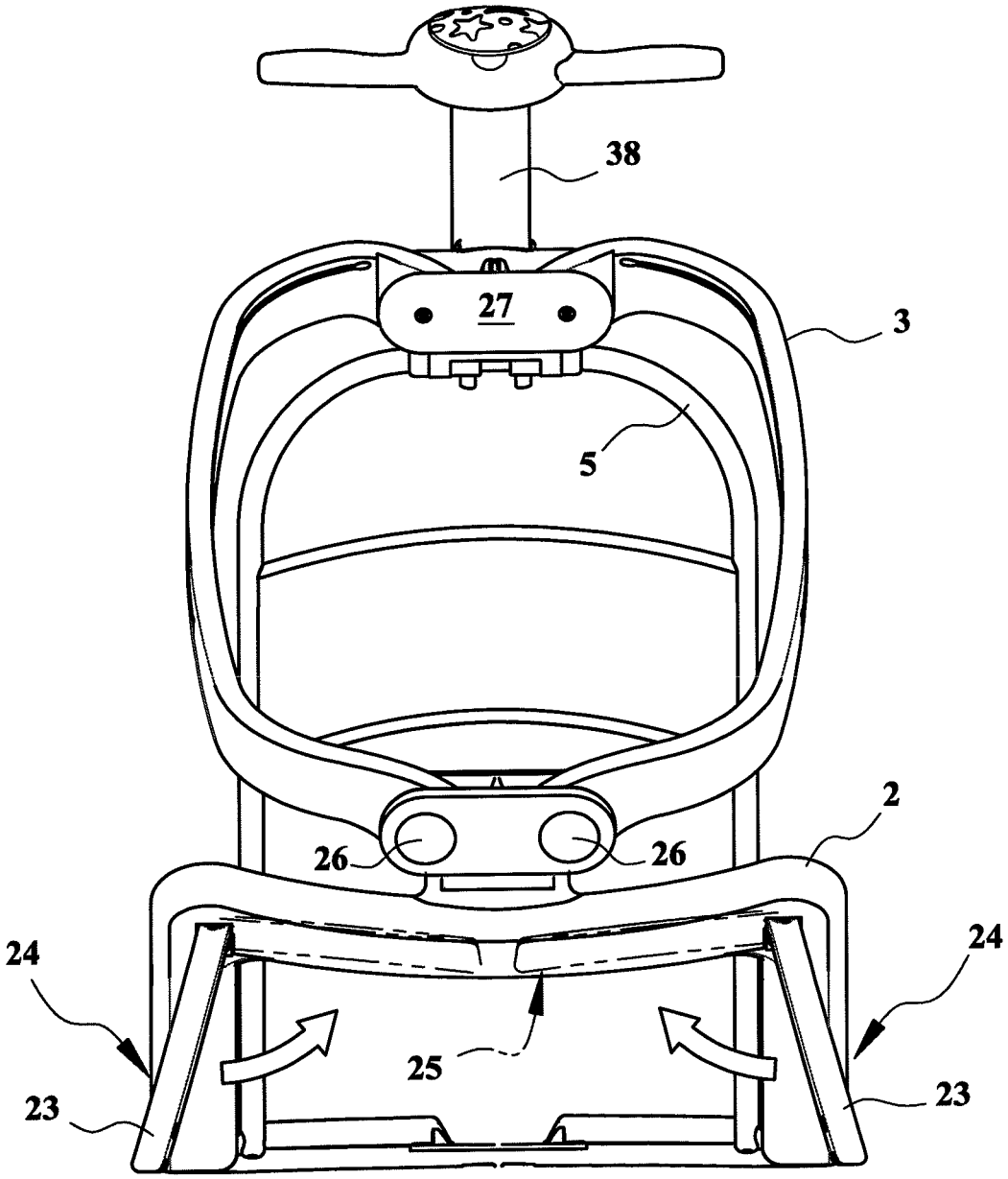
FIG. 3 is a rear view showing the frame of the convertible rocking chair converted to a rocking-horse from a chair.

Referring to FIG. 2, the arched base rack 2 has a curved downside for rocking and rolling back and forth against ground. Preferably, a rotatable strut 23 may be pivoted at the front end 21 of the arched base rack 2. Referring to FIG. 3, the rotatable strut 23 may be rotated and locked in a stretched position 24 and a withdrawn position 25, and capable of stopping the arched base rack 2 from rocking and rolling in the stretched position 24, and permits the arched base rack 2 to rock and roll in the withdrawn position 25.

For folding and keeping the frame 1 into a compact configuration 53 for store or travel, a locking mechanism 6 may operatively mounted between the second connecting mount 27 and the arched rack 2, for locking the second connecting mount 27 to the arched rack 2 so as to keep the lifting rack 5 to close to the arched rack 2. Preferably, the rear end 22 of the arched rack 2 may be formed with an engageable indent 61 or slot (not shown), and the locking mechanism 6 may include an engageable element 62 or a spring biased hook element (not sown) for releasably engaging with the engageable indent 61.

The seat frame 3 of this embodiment includes a left-side rack 31 and a right-side rack 32 for stretching a fabric cover 90 therebetween. The left-side rack 31 and right-side rack 32 each has one end pivoted to the front end 21 of the arched base rack 2 by a first connecting mount 26 so as to lock in the first position 33 and the second position 34.

Figure 13:
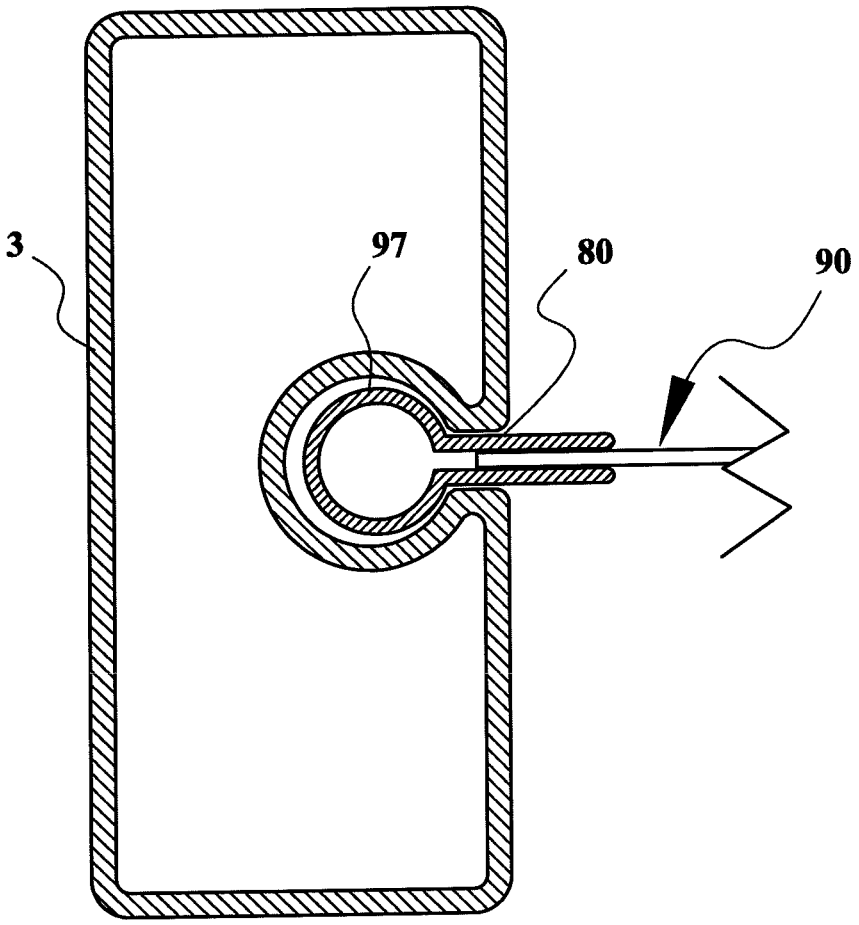
FIG. 13. is a schematic cross-sectional view showing an embodiment of the seat frame and the fabric cover.

Referring to FIG. 13, for easy assembly to the seat frame 3 and replacement of the fabric cover 90, the fabric cover 90 is preferably included an expanded edge 97, and the left-side rack 31 and right-side rack 32 each may have a groove formed with a narrower opening 80 for biting or engaging with the expanded edge 97 for detachably connecting and stretching the fabric cover 90 therebetween.

Figure 4:
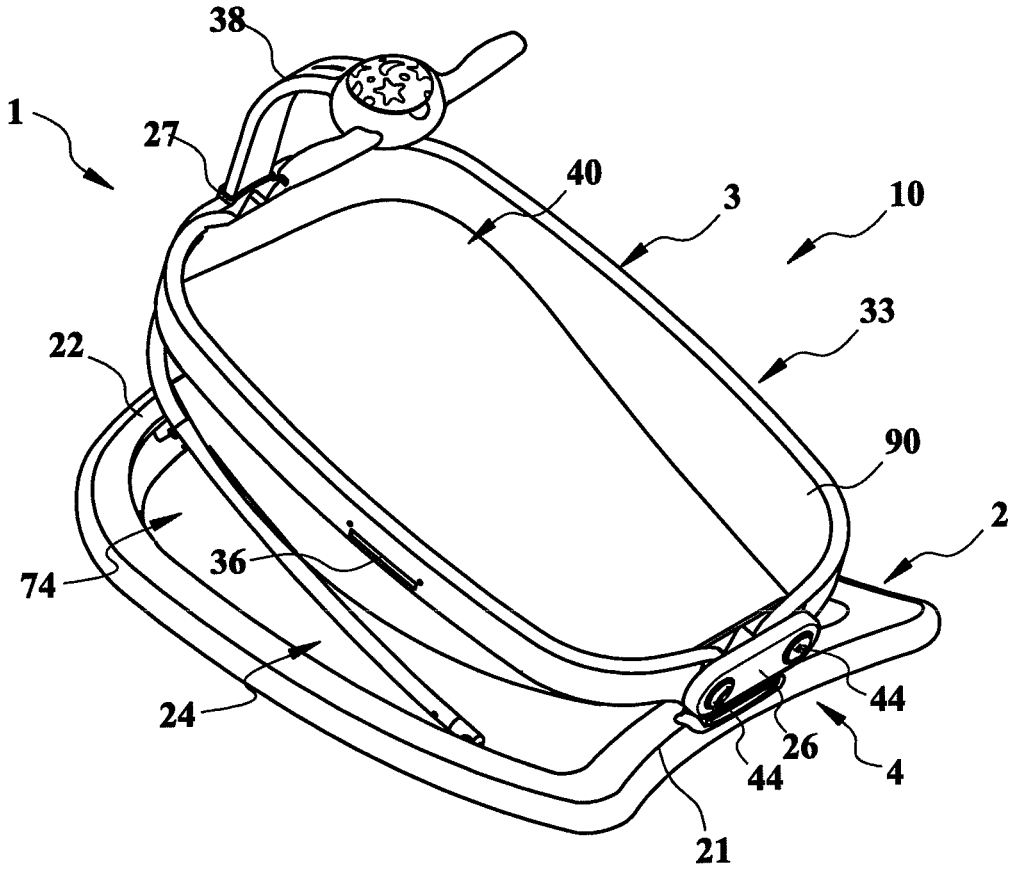
FIG. 4 is a perspective view showing the frame of the convertible rocking chair being converted to use as a rocking-horse.
Figure 5:
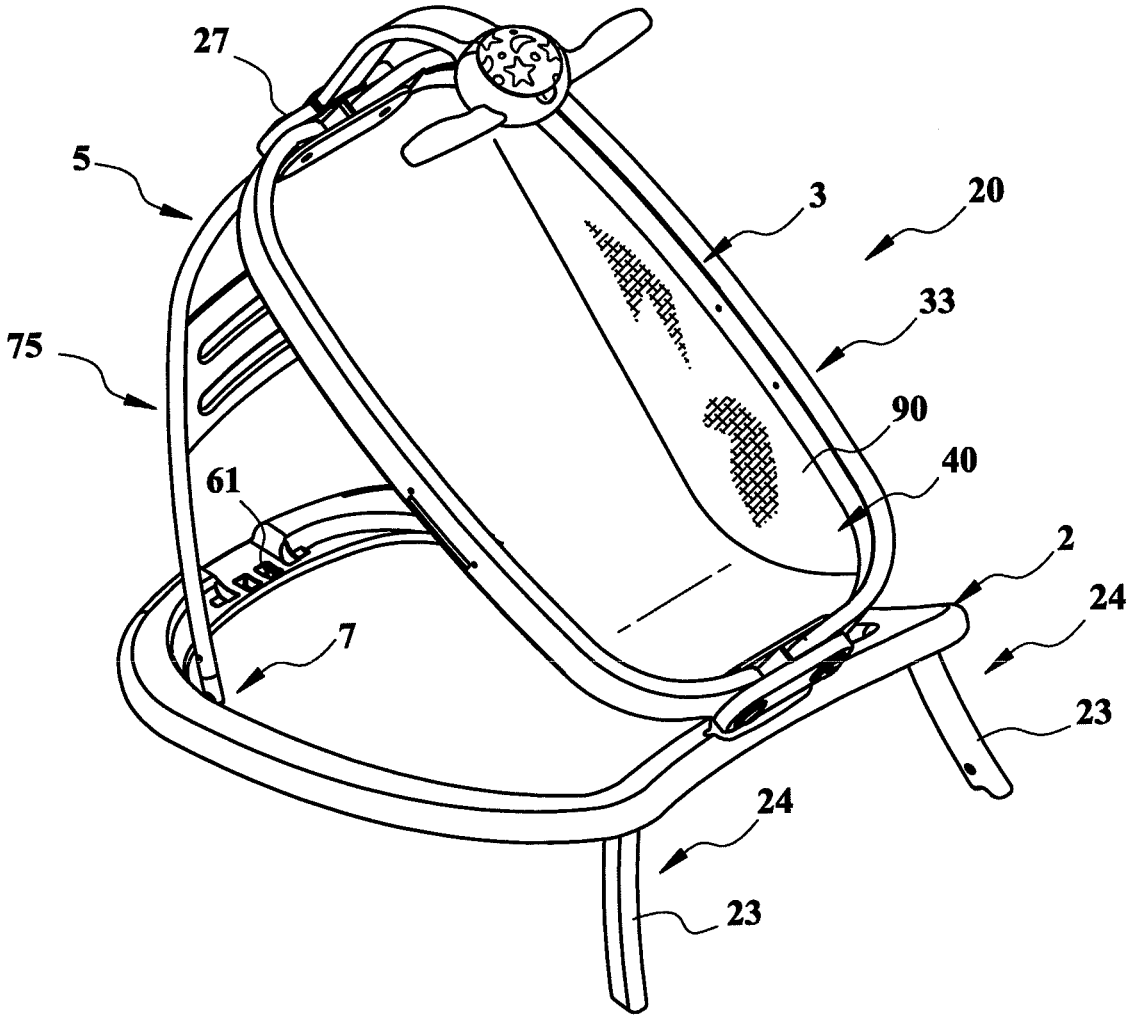
FIG. 5 is a perspective view showing the frame of the convertible rocking chair being converted to use as a chair.
Figure 6:
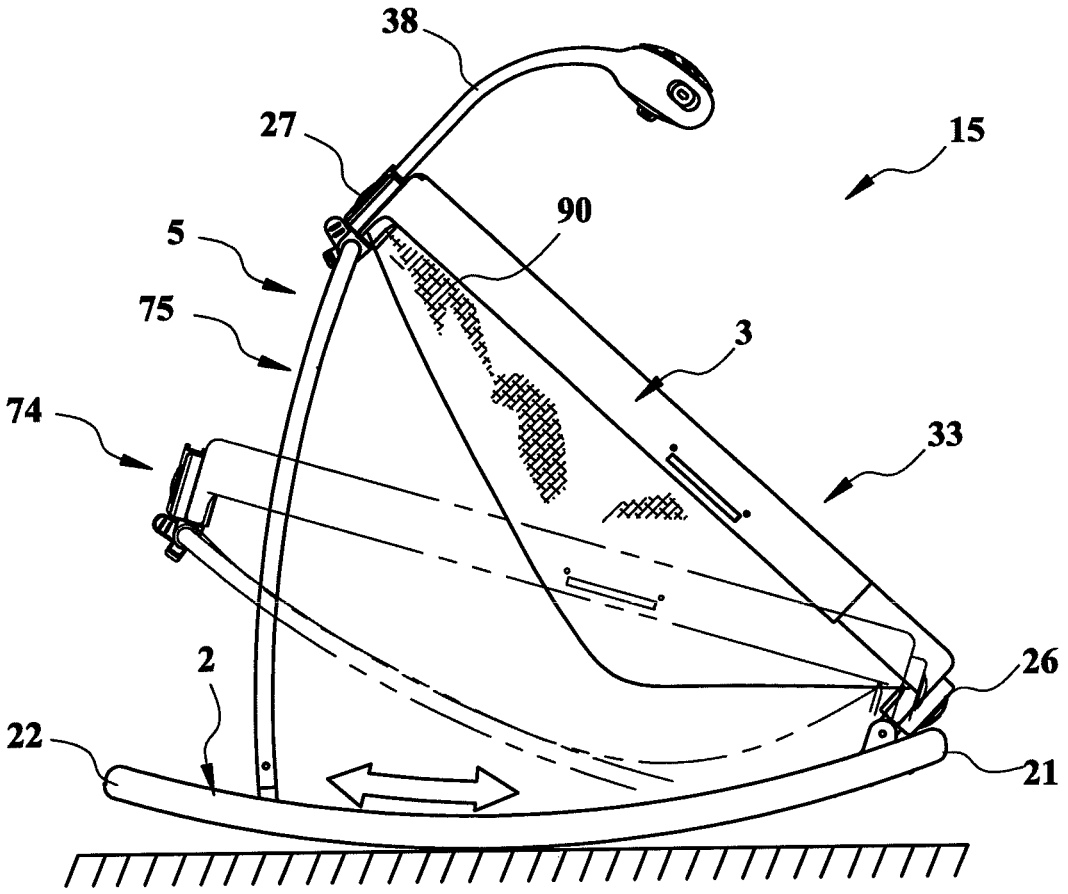
FIG. 6 is a side view showing the frame of the convertible rocking chair being used as a rocking chair.
Figure 7:
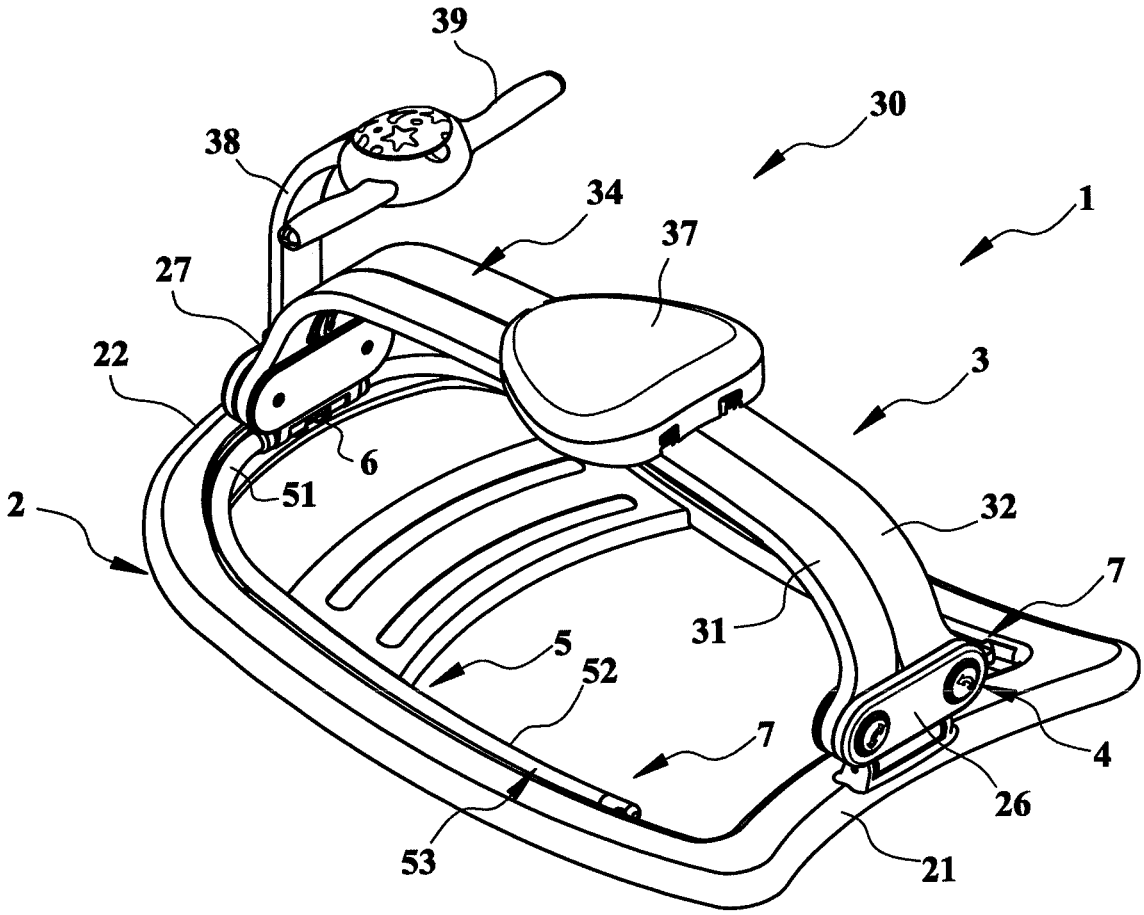
FIG. 7. is a side view showing the frame of the convertible rocking chair being used as a rocking-horse.
Figure 8:
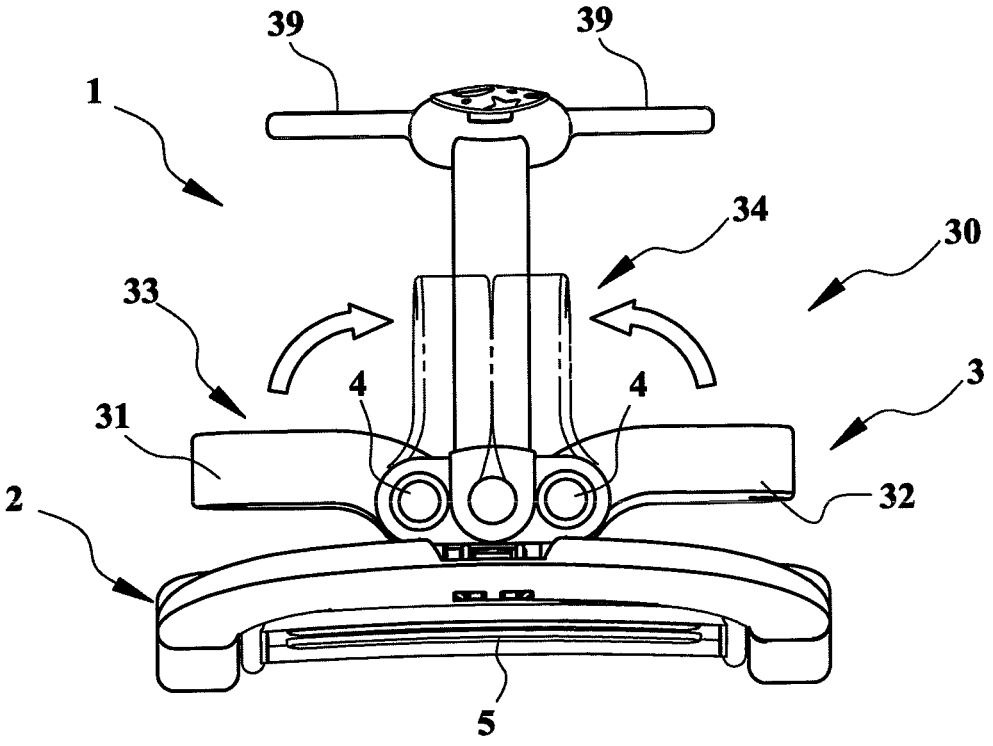
FIG. 8. is a rear view showing the operation of converting the convertible rocking chair to a rocking-horse.
Figure 9:
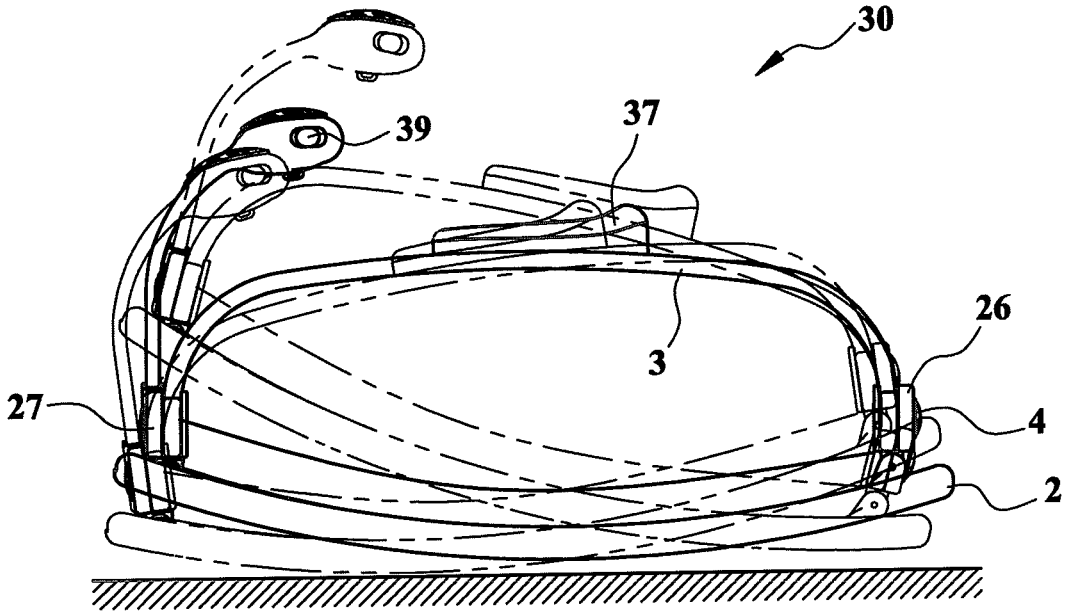
FIG. 9. is a side view showing the convertible rocking chair used as the rocking-horse.

Referring to FIGS. 4 to 6, when the left-side rack 31 and right-side rack 32 are locked in the first position 33, an accommodating space 40 with the stretched fabric cover 90 provided therebetween, this would allow the frame 1 of the rocking chair 15 to convert to a rocking-bed 10. Referring to FIGS. 7 to 9, when the left-side rack 31 and right-side rack 32 are locked in the second position 34, the middle portion 35 of the left-side rack 31 and right-side rack 32 are met together for connecting or engaging with the seat board 37, this would permit the frame 1 of the rocking chair 15 to converted to a rocking-horse 30. Referring back to FIG. 2, the middle portion 35 of the left-side rack 31 and right-side rack 32 each may be formed with a slot 36 or provided with a connecting element (not shown) for connecting with the seat board 37.

For tilting up and adjusting the inclination of the seat frame 3, a lifting rack 5 is adjustably connected between the seat frame 3 and the arched base rack 2. Referring to FIG. 2, the lifting rack 5 has a lower end 52 movably and lockably engaged with the arched base rack 2, and an upper end 51 pivoted with the seat frame 3 by a second connecting mount 27.

Preferably, the frame 1 of the convertible rocking chair 15 may further include a lock-and-release mechanism 7 as shown in FIG. 2 which is operatively connected between the lower end 52 of the lifting rack 5 and the arched rack 2, by changing and repositioning the lower end 52 along the arched rack 2 to adjust and lock the seat frame 3 in at least a first inclination position 74 and a second inclination position 75. For example, when the convertible rocking chair 15 is converted to a rocking-bed 10, the seat frame 3 can be locked in the first inclination position 74, and when the convertible rocking chair is used as a chair 20, the seat frame 3 is locked in the second inclination position 75.

It would also be appreciated that the arched rack 2 may be provided with a guiding rail 71 formed with a plurality of positioning holes 72 for guiding and positioning the lower end 52 of lifting rack 5, and the lock-and-release mechanism 7 may include a lock member 73 retractively receiver in the lower end 52 for engaging with one of the positioning holes 72 thereby locking the seat frame 3 in the first inclination position 74 and the second inclination position 75.

When the convertible rocking chair 15 is converting to the rocking-horse 30, the second connecting mount 27 may further be connected with a handle post 38 which provided with a pair of handles 39 for holding by hands of little occupant.

Referring to FIGS. 4 to 7, when the frame 1 being converted to the rocking-bed 10, rocking chair 15, chair 20 or rocking-horse 30, the first end of the lifting rack 5 may move and position along the arched base rack 2 thereby adjusting and support the seat frame 3 in a selected inclination.

For releasably locking the left-side rack 31 and right-side rack 32 in the first position 33 and the second position 34, a positioning mechanism 4 may mount between the first connecting mount 26, the second connecting mount 27, the left-side rack 31 and the right-side rack 32.

In the embodiment shown in FIG. 2, the left-side rack 31 and right-side rack 32 may be formed with a plurality of positioning slots 41 at both ends for engaging with the positioning mechanism 4.

The positioning mechanism 4 may include a plurality of spring-biased locking elements 42 (biased by spring 43) and a plurality of push buttons 44. The plurality of spring-biased locking elements 42 are used to engage with the plurality of positioning slots 41 thereby locking the left-side rack 31 and right-side rack 32 in the first position 33 and the second position 34.

The plurality of push buttons 44 are used to disengage the spring-biased locking elements 42 from the plurality of positioning slots 41 so as to unlock the left-side rack 31 and right-side rack 32 from the first position 33 and the second position 34, as the operation schematically shown in FIG. 8.

Figure 10:
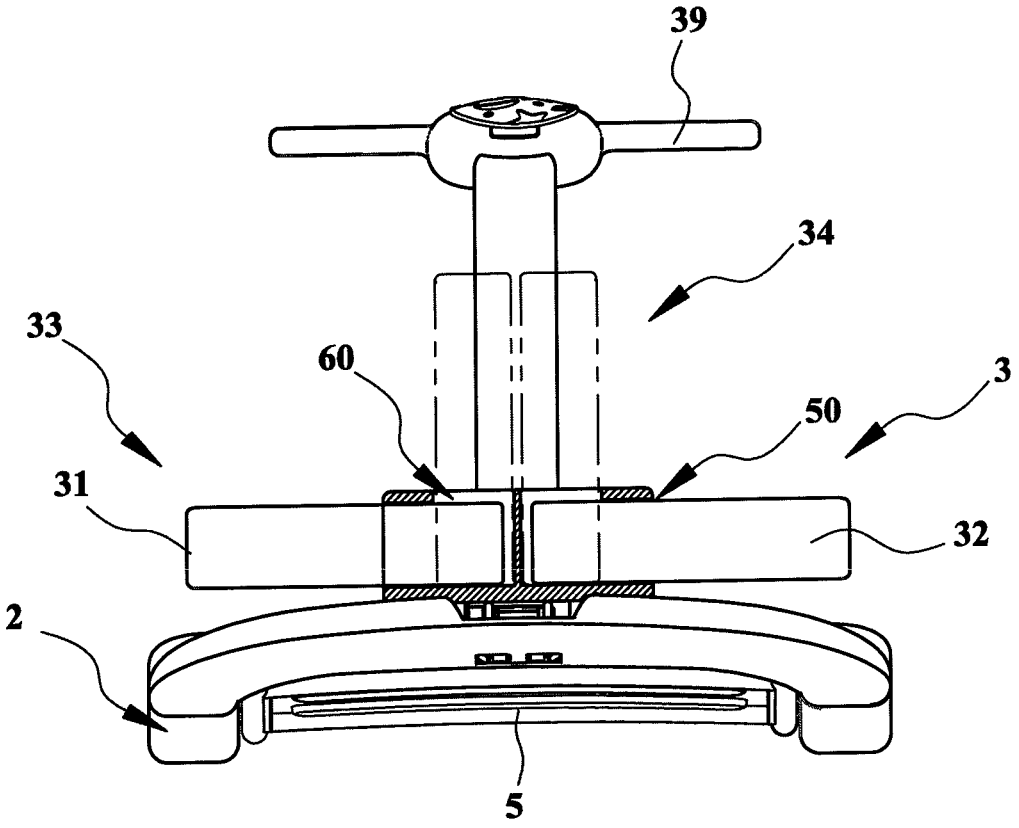
FIG. 10. is a rear view showing an alternative embodiment of the frame of the convertible rocking chair according to the present invention.

Referring to FIG. 10, the first connecting mount 26 and second connecting mount 27 may be embodied as a connector formed with two first sockets 50 in a horizontal direction and two second sockets 60 in a vertical direction. In this alternative embodiment, the ends of the left-side rack 31 and right-side rack 32 may insert into the first sockets 50 for self-keeping in the first position 33. In the same way, the ends of the left-side rack 31 and right-side rack 32 may also insert into the second sockets 60 for self-keeping in the second position 34.

Figure 11:
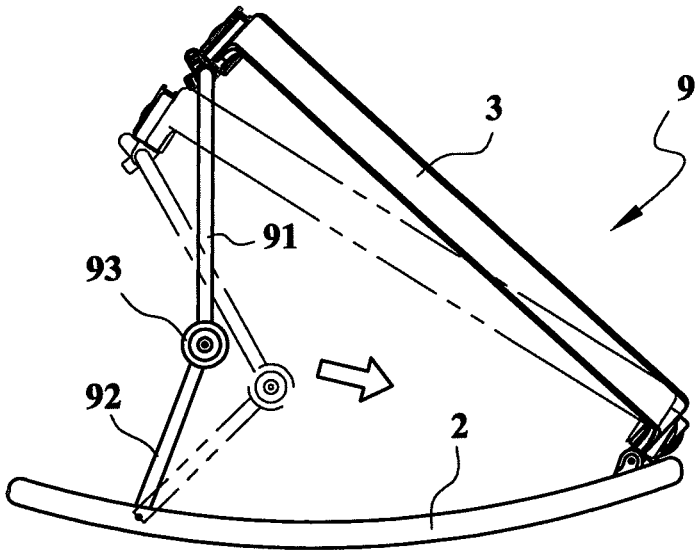
FIG. 11. is a side view showing another alternative embodiment of the frame of the convertible rocking chair according to the present invention.

Referring to FIG. 11, an alternative embodiment of the lifting rack 9 may comprise an upper section 91, a lower section 92 and a lockable joint 93. The upper section 91, having an upper end connected with the seat frame 3. The lower section 92, having a lower end connected with the arched base rack 2. The lockable joint 93 may be connected between the upper section 91 and the lower section 92. In this alternative embodiment, the upper section 91 and the lower section 92 are capable of changing in angles by releasing and locking the lockable joint 93 thereby keeping the seat frame 3 in a first inclination position 74 and a second inclination position 75.

Figure 12:
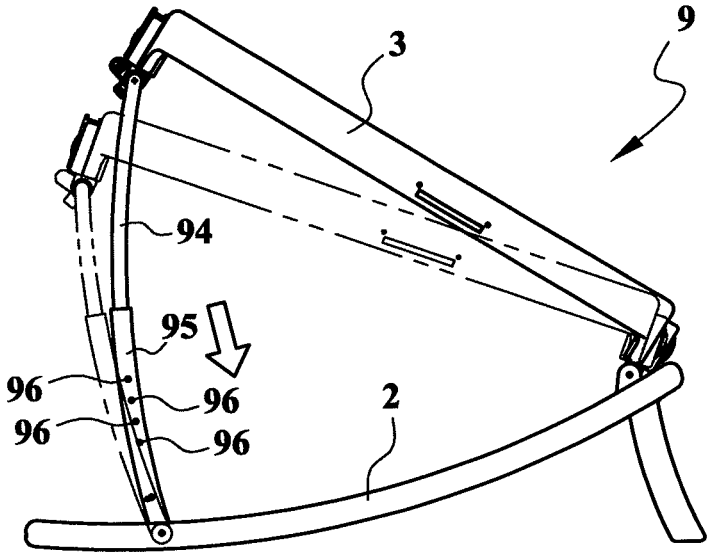
FIG. 12. is a side view showing another alternative embodiment of the frame of the convertible rocking chair according to the present invention.

Referring to FIG. 12, another alternative embodiment of the lifting rack 9 may be embodied as a telescopic assembly, for instance, the lifting rack 9 of this embodiment may include an inner tube functioning as an upper section 94, an outer tube functioning as a lower section 95. The upper section 94 is retractable relative to the lower section 95, so as to adjust the inclination of the seat frame 3. Preferably, the lower section 95 may have a plurality of positioning holes 96 for engaging with a locking element (not shown) installed between the upper section 94 and the lower section 95, so as to lock the seat frame 3 in a selected inclination.

While particular embodiments of the invention have been described, those skilled in the art will recognize that many modifications are possible that will achieve the same goals by substantially the same system, device or method, and where those systems, devices or methods still fall within the true spirit and scope of the invention disclosed.

What is claimed is:

1. A convertible rocking chair, including:

an arched base rack, having a first connecting mount mounted at a front end thereof, and a curved downside for rocking and rolling back and forth against ground;

a lifting rack, having a lower end movably and lockably engaged with the arched base rack, and having a second connecting mount mounted at an upper end thereof;

a seat frame, having a left-side rack and a right-side rack for stretching a fabric cover therebetween; wherein the left-side rack and right-side rack are lockably connected between the first connecting mount and the second connecting mount; and two positioning mechanism, mounted in the first connecting mount and the second connecting mount respectively for locking the left-side rack and right-side rack in a first position in which the left-side rack and right-side rack can stretch the fabric cover therebetween to form an accommodating space of the rocking chair, and a second position in which the left-side rack and right-side rack are in contact.

2. The convertible rocking chair of claim 1, further including rotatable strut pivoted at one end of the arched base rack; wherein the rotatable strut can be rotated and locked in a stretched position and a withdrawn position, and capable of stopping the arched base rack from rocking and rolling in the stretched position, thereby converting the rocking chair into a chair.

3. The convertible rocking chair of claim 1, wherein the lifting rack is capable of adjusting and support the seat frame in an inclination by moving the lower end thereof along the arched base rack.

4. The convertible rocking chair of claim 3 further includes a lock-and-release mechanism operatively connected between a lower end of the lifting rack and the arched base rack, for repositioning the lower end of the lifting rack along the arched base rack, so as to adjust and lock the seat frame in at least two inclination positions.

5. The convertible rocking chair of claim 1, wherein the left-side rack and right-side rack are formed with a plurality of positioning slots at the both ends thereof for engaging with the two positioning mechanism so as to be locked in the first position and the second position; and wherein the two positioning mechanism includes:

a plurality of spring-biased locking elements for engaging with the plurality of positioning slots so as to lock the left-side rack and right-side rack in the first position and the second position; and a plurality of push buttons for disengaging the spring-biased locking elements from the plurality of positioning slots so as to unlock the left-side rack and right-side rack from the first position and the second position.

6. The convertible rocking chair of claim 5, wherein the arched rack is provided with a guiding rail for guiding the lower end of the lifting rack and formed with a plurality of positioning holes, and the lock-and-release mechanism includes a lock member retractively receiver in the lower end of the lifting rack for engaging with one of the positioning holes thereby locking the seat frame in a first inclination position and a second inclination position.

7. The convertible rocking chair of claim 1, wherein the first connecting mount and the second connecting mount each is formed with a first socket and a second socket for locking the left-side rack and right-side rack in the first position to stretch the fabric cover therebetween and the second position to come into contact for connecting a seat board.

8. The convertible rocking chair of claim 1, wherein the lifting rack comprises:

an upper section, having an upper end connected with the left-side rack and right-side rack;

a lower section, having an lower end connected with the arched base rack; and a lockable joint connected between the upper section and the lower section; wherein the upper section and the lower section are capable of changing in angles by releasing and locking the lockable joint thereby keeping the seat frame in at least two inclination positions.

9. The convertible rocking chair of claim 1, further includes a locking mechanism operatively mounted between the second connecting mount and the arched rack, for locking the second connecting mount to the arched rack so as to keep the lifting rack to close to the arched rack.

10. The convertible rocking chair of claim 9, wherein the arched rack is formed with an engageable indent, and the locking mechanism includes an engageable element for releasably engaging with the engageable indent.

11. The convertible rocking chair of claim 1, wherein the fabric cover includes an expanded edge, and the left-side rack and right-side rack each has a groove formed with a narrower opening for engaging with the expanded edge thereby detachably connecting and stretching the fabric cover therebetween.

12. The convertible rocking chair of claim 1 further includes a seat board, and the two positioning mechanism can lock the left-side rack and the right-side rack in the second position for engaging with the seat board thereby converting the rocking chair into a rocking-horse.

13. The convertible rocking chair of claim 12, further includes a handle post connected to the second connecting mount for holding by hands of an occupant.

* * * * *